US011152730B2

(12) United States Patent
Nishii

(10) Patent No.: US 11,152,730 B2
(45) Date of Patent: Oct. 19, 2021

(54) TERMINAL WITH LEAF SPRING EXTENDING REARWARD FROM SUPPORT AT BOTH SIDE WALLS

(71) Applicant: Sumitomo Wiring Systems, Ltd., Mie (JP)

(72) Inventor: Hiroko Nishii, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/768,927

(22) PCT Filed: Dec. 5, 2017

(86) PCT No.: PCT/JP2017/043637
§ 371 (c)(1),
(2) Date: Jun. 2, 2020

(87) PCT Pub. No.: WO2019/111320
PCT Pub. Date: Jun. 13, 2019

(65) Prior Publication Data

US 2021/0167537 A1 Jun. 3, 2021

(51) Int. Cl.
*H01R 13/02* (2006.01)
*H01R 13/115* (2006.01)
(Continued)

(52) U.S. Cl.
CPC ..... *H01R 13/115* (2013.01); *H01R 4/185* (2013.01); *H01R 13/113* (2013.01)

(58) Field of Classification Search
CPC ..... H01R 13/115; H01R 13/11; H01R 13/10; H01R 13/02; H01R 13/113; H01R 4/184;
(Continued)

(56) References Cited

U.S. PATENT DOCUMENTS 6,024,612 A * 2/2000 Myer ..... H01R 13/113 439/744
6,062,918 A * 5/2000 Myer ..... H01R 13/187 439/833
(Continued)

FOREIGN PATENT DOCUMENTS

JP 2001-185269 7/2001
JP 2017-142978 8/2017
(Continued)

OTHER PUBLICATIONS

International Search Report dated Feb. 27, 2018.

*Primary Examiner* — Harshad G Patel
(74) *Attorney, Agent, or Firm* — Gerald E. Hespos; Michael J. Porco; Matthew T. Hespos

(57) ABSTRACT

A female terminal includes a tubular body (10) with a bottom wall (11), first and second side walls (12, 13) and a ceiling (14). The first side wall (12) has a supporting hole (12A) and the second side wall (13) has an engaging hole (13A). An engaging projection (14A) projects from the ceiling (14) and into the engaging hole (13A). A leaf spring (20) is cantilevered in the tubular body (10) and includes a base (22), a flexible portion (26) extending rearward from the base (22), a coupling (23) coupling the base (22) to the second side wall (13), and a support (24) projecting from a side of the base (22) opposite the coupling (23) and into the supporting hole (12A). The free end (25) of the flexible portion (26) can contact the ceiling while avoiding the engaging projection (14A) when the flexible portion (26) is deformed toward the ceiling.

2 Claims, 13 Drawing Sheets

(51) Int. Cl.
*H01R 4/18* (2006.01)
*H01R 13/11* (2006.01)

(58) Field of Classification Search
CPC . H01R 4/183; H01R 4/18; H01R 4/16; H01R 4/10
USPC ..... 439/352, 345, 346, 362, 364, 619, 660, 439/678, 699.1, 708, 723, 290, 607.01, 439/850–855, 578, 878, 879
See application file for complete search history.

(56) References Cited

U.S. PATENT DOCUMENTS 6,290,553 B1 * 9/2001 Sato ..... H01R 13/187 439/843
6,527,601 B2 * 3/2003 Chen ..... H01R 13/187 439/852
6,905,376 B2 * 6/2005 Chen ..... H01R 13/04 439/595
7,976,351 B2 * 7/2011 Boemmel ..... H01R 13/432 439/748
10,122,108 B2 * 11/2018 Bhagyanathan Sathianathan ..... H01R 13/432
11,024,983 B2 * 6/2021 Onuma ..... H01R 4/184
2001/0024913 A1 * 9/2001 Kitamura ..... H01R 13/113 439/852
2008/0070452 A1 * 3/2008 Komiyama ..... H01R 13/113 439/852
2008/0280510 A1 * 11/2008 Moll ..... H01R 13/113 439/877
2015/0050838 A1 2/2015 Copper et al.

FOREIGN PATENT DOCUMENTS

JP 2017-143028 8/2017
JP 2017-204396 11/2017

* cited by examiner

TERMINAL WITH LEAF SPRING EXTENDING REARWARD FROM SUPPORT AT BOTH SIDE WALLS

BACKGROUND

Field of the Invention

This specification relates to a terminal.

Related Art

Japanese Unexamined Patent Publication No. 2001-185269 discloses a female terminal with a spring-like fitting portion to be connected to a tab-shaped mating terminal. This female terminal is formed from a metal plate material that is stamped and bent to form a spring contact portion in the form of a tongue by partially cutting and raising a part that will become a bottom wall of the fitting portion. The plate material is bent to embrace this spring contact portion from both sides, and both end parts are overlapped to form a ceiling wall. A tab of the mating terminal is inserted into the fitting portion and is sandwiched by the ceiling wall of a rectangular tube and the spring contact portion. In this way, a connected state where the mating terminal and the spring contact portion are conductively connected is maintained.

However, the spring contact portion is formed by being cut and raised from the bottom wall in this configuration. Thus, a sufficient strength of the fitting portion cannot be obtained in some cases.

SUMMARY

A terminal according to this specification integrally includes a tubular body composed of a bottom wall, a first side wall, a second side wall and a ceiling wall. A leaf spring is cantilevered to extend in the tubular body. The first side wall is provided with a supporting hole, and the second side wall is provided with an engaging hole. The ceiling wall is provided with an engaging projection projecting toward the bottom wall and disposed in the engaging hole. The leaf spring includes a base end, a flexible portion extending rearward from the base end, a coupling that couples the base end to the second side wall, and a supporting projection that projects from a side edge of the base end opposite to the coupling and that is disposed in the supporting hole. The free end of the flexible portion is capable of contacting with the ceiling wall while avoiding the engaging projection when the flexible portion is resiliently deformed toward the ceiling wall.

According to this configuration, the leaf spring is coupled to the second side wall. Thus, the terminal can have a higher strength, for example, as compared to the case where the leaf spring is formed by cutting and raising a part of the ceiling wall. Further, the base end has both side edges supported by the coupling and the supporting projection. Thus, a reduction of a contact load of the leaf spring due to an opening deformation of the base end or the like according to resilient deformation of the flexible portion can be avoided. Furthermore, the leaf spring is supported at two points of the base end and the free end in the tubular body. Thus, a sufficient contact load can be ensured.

The flexible portion may be a part closer to the free end than a straight line connecting the coupling and the supporting projection and may be provided with a contact portion capable of contacting a mating terminal. Additionally, the supporting projection may be provided at a position so that a center of gravity of the flexible portion overlaps the contact portion. According to this configuration, the free end of the leaf spring is in contact with the ceiling wall at a position near the first side wall while avoiding the engaging projection. However, the center of gravity of the flexible portion overlaps the contact portion. Thus, the leaf spring can be kept in a stable posture even when contacting the mating terminal.

According to this specification, it is possible to ensure the strength of a terminal and ensure a sufficient contact load.

DETAILED DESCRIPTION

An embodiment according to this specification is described with reference to FIGS. 1 to 13.

Figure 1:
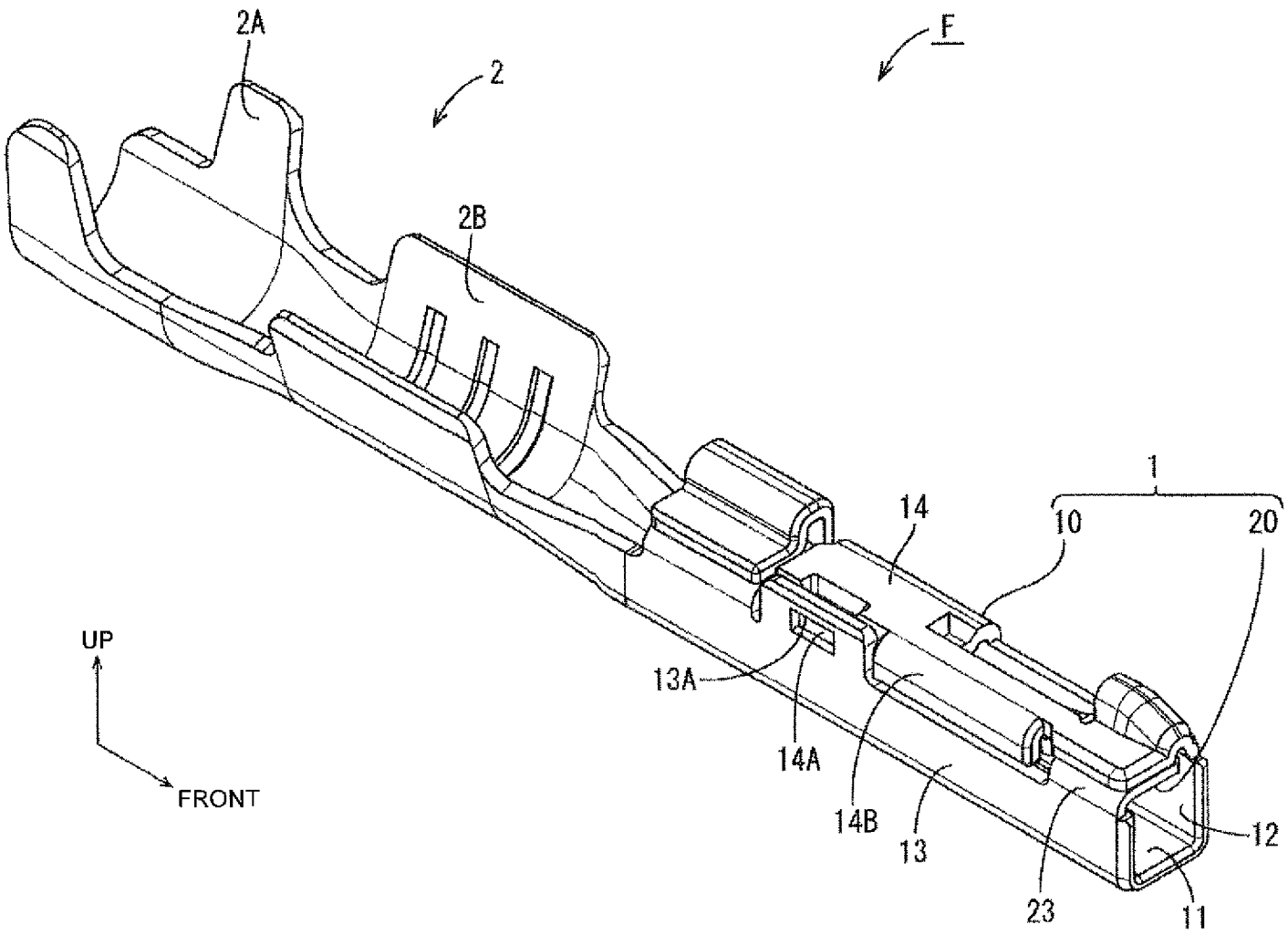
FIG. 1 is a perspective view of a female terminal viewed from the side of a second side wall.
Figure 2:
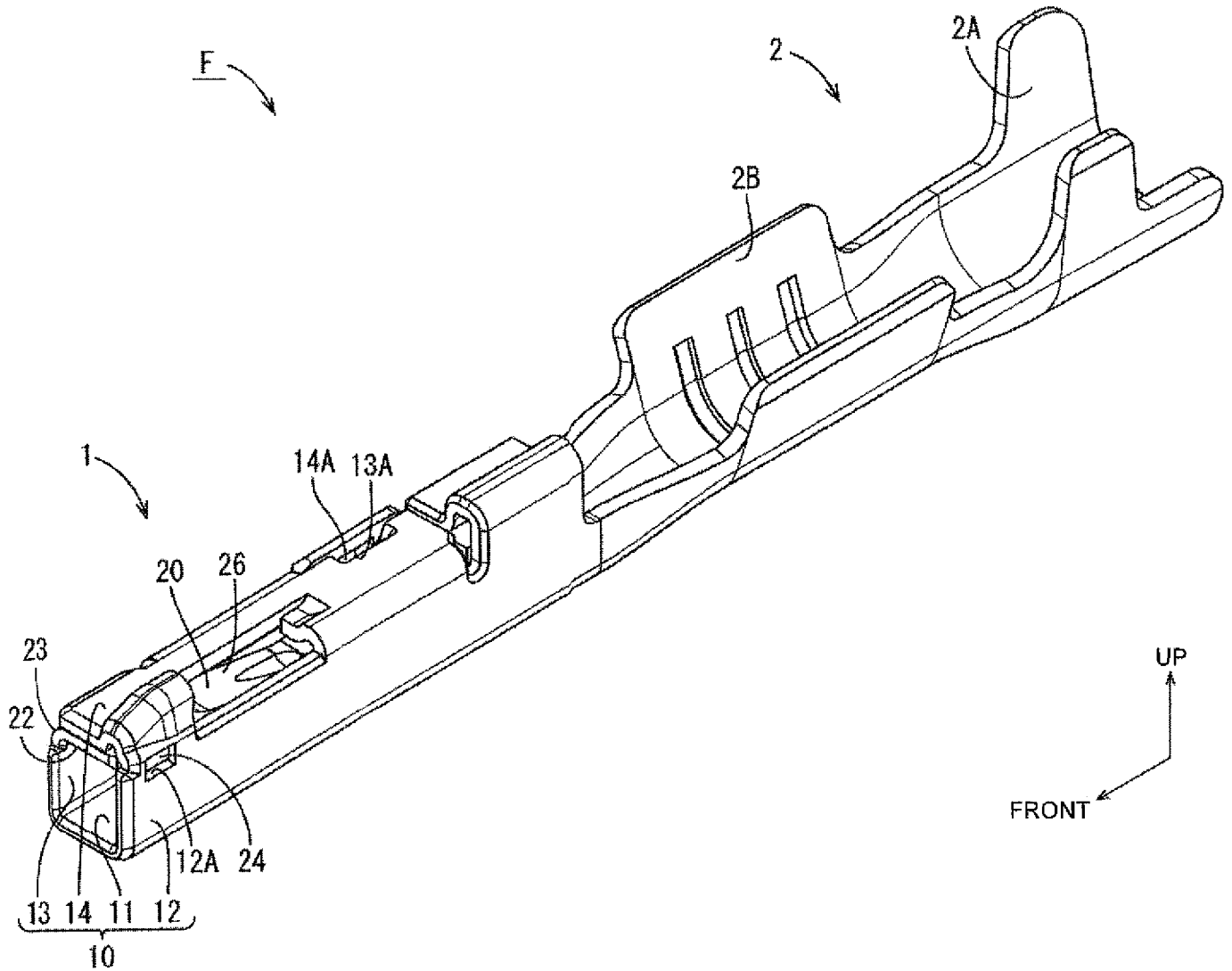
FIG. 2 is a perspective view of the female terminal viewed from the side of a first side wall.

A female terminal F (an example of a terminal) of this embodiment includes a wire connecting portion 2 to be connected to an unillustrated wire and a fitting 1 to be fit to a tab-shaped mating terminal M and is shaped to extend in one direction as shown in FIGS. 1 and 2. The wire connecting portion 2 and the fitting 1 are formed from one metal plate. In the following description, an upper side in FIG. 1 is referred to as an upper side and an opening side of the fitting portion 1 is referred to as a front.

The wire connecting portion 2 includes V-shaped insulation barrel 2A and wire barrel 2B, each of which is open upward as shown in FIGS. 1 and 2. The insulation barrel 2A is crimped to a coating portion of the unillustrated wire, and the wire barrel 2B is crimped to a core extending from the coating portion.

The fitting 1 includes, as shown in FIGS. 1 and 2, a tubular body 10 open forward and a leaf spring 20 disposed inside the tubular body 10.

The tubular body 10 is composed of a bottom wall 11, a first side wall 12 extending up from one lateral side of the bottom wall 11, a second side wall 12 extending up from the other lateral side of the bottom wall 11 and facing the first side wall 12, and a ceiling 14 extending from the upper end of the first side wall 12 and facing the bottom wall 11. In this embodiment, the bottom wall 11, the first and second side walls 12, 13 and the ceiling 14 are in the form of a flat plates elongated in a front-rear direction, and the tubular body 10 is in the form of a rectangular tube having a substantially square cross-section as a whole.

Figure 4:
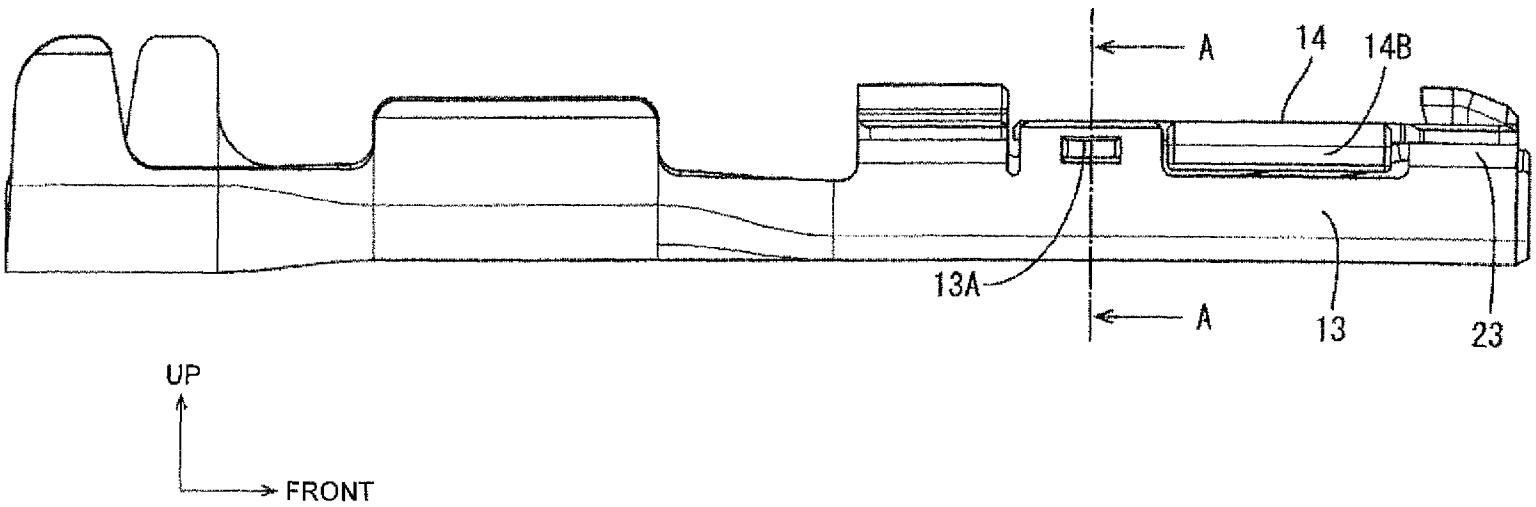
FIG. 4 is a side view of the female terminal viewed from the side of the second side wall.
Figure 5:
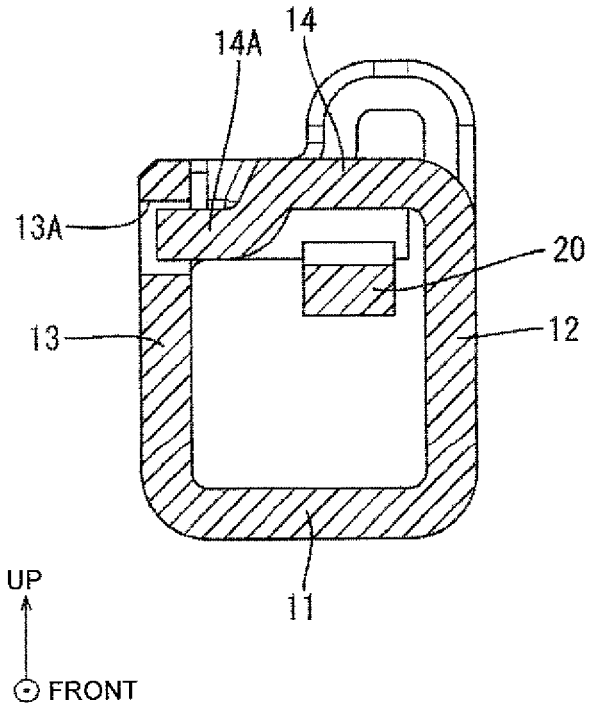
FIG. 5 is a section along A-A of FIG. 4.
Figure 6:
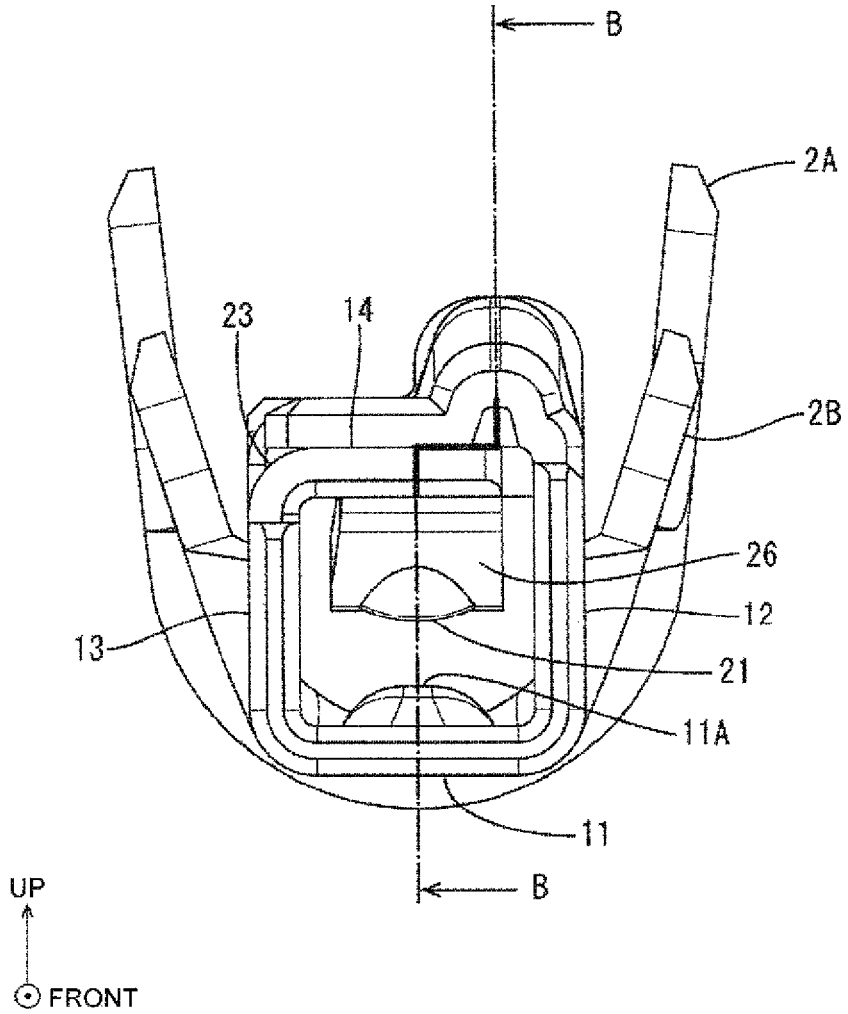
FIG. 6 is a front view of the female terminal.

As shown in FIGS. 1 and 4, a rear end part of the second side wall 13 extends to the same height as the upper surface of the ceiling 14 and a flat rectangular engaging hole 13A penetrates through this extending part in a thickness direction. As shown in FIG. 5, an upper edge of the engaging hole 13A is substantially at the same height position as the lower surface of the ceiling 14.

Figure 3:
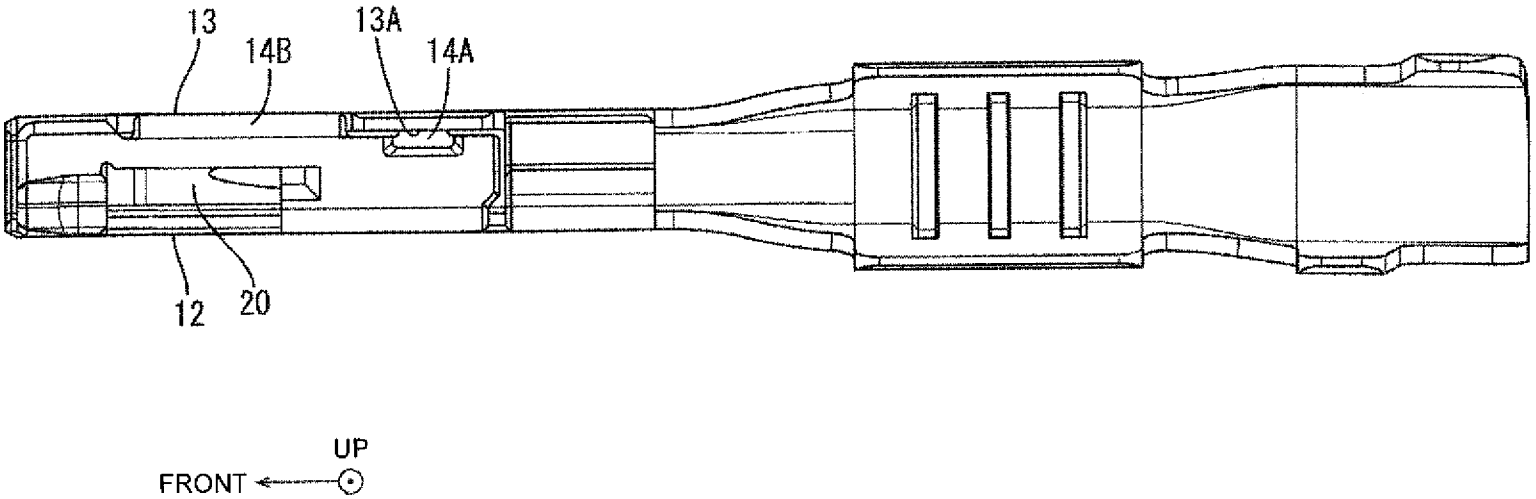
FIG. 3 is a plan view of the female terminal.
Figure 9:
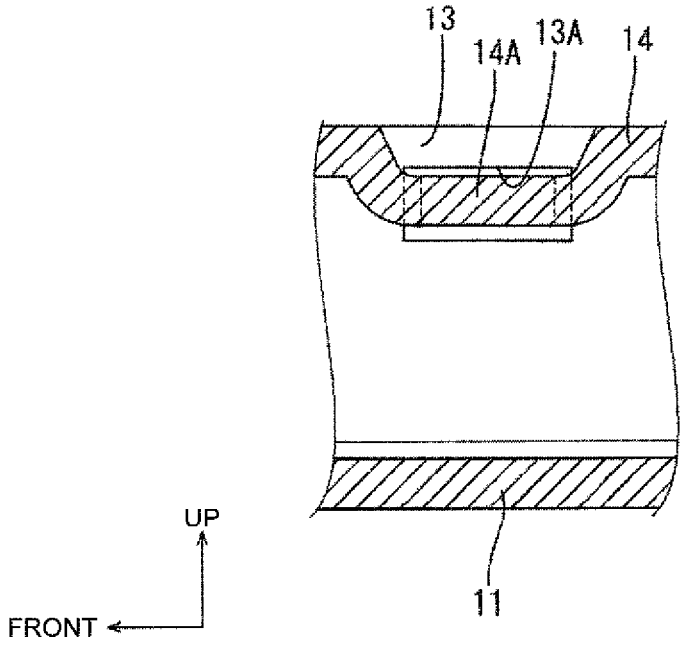
FIG. 9 is a section along D-D of FIG. 8.
Figure 10:
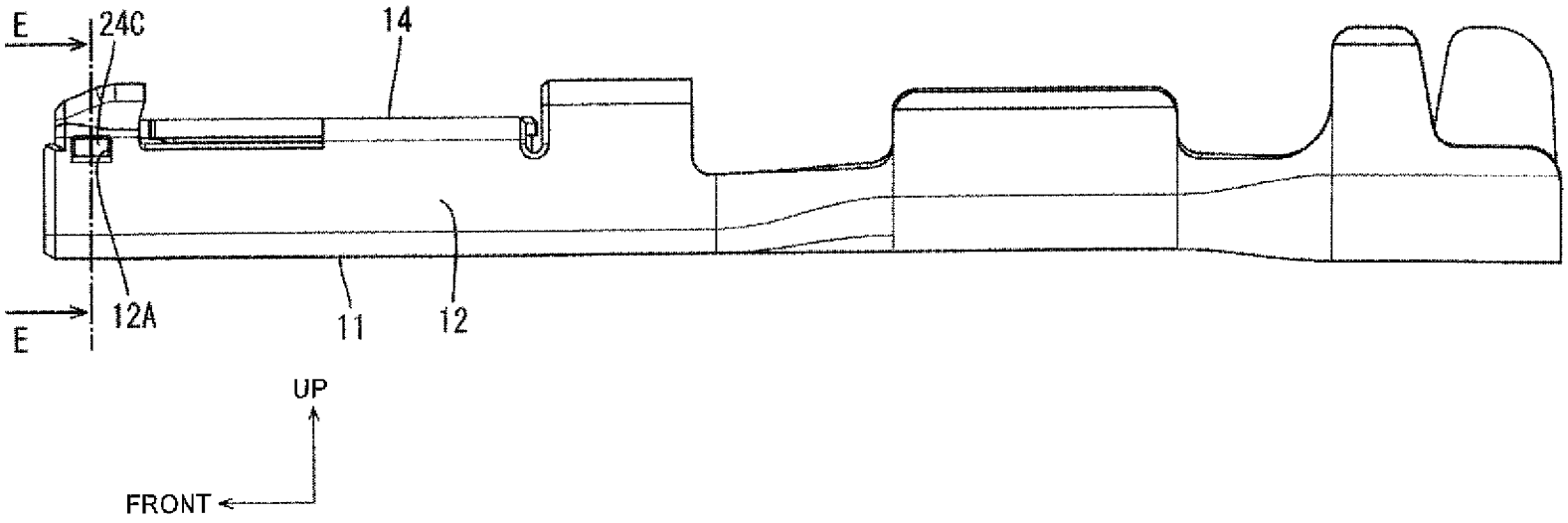
FIG. 10 is a side view of the female terminal viewed from the side of the first side wall.

In correspondence with this, an engaging projection 14A to be engaged with the engaging hole 13A is provided near the rear end of the ceiling 14. As shown in FIGS. 3, 5 and 9, the engaging projection 14A is formed by downwardly striking a part of the ceiling 14 closer to the second side wall 13 than a center line in a lateral direction, and projects inwardly of the tubular body 10 while forming such a step as to be located below the ceiling 14 by substantially a plate thickness. Further, a lateral end of the engaging projection 14A is struck laterally to project farther laterally than an end edge of the ceiling 14 by a distance not more than the plate thickness of the second side wall 13, and this projecting part is inserted into the engaging hole 13A. In this way, an upward rotational displacement of the ceiling 14 about a boundary with the first side wall 12 is restricted.

As shown in FIG. 2, a supporting hole 12A for supporting the leaf spring 20, as described later, penetrates in the plate thickness direction through an upper part of the first side wall 12 near a front end.

Figure 7:
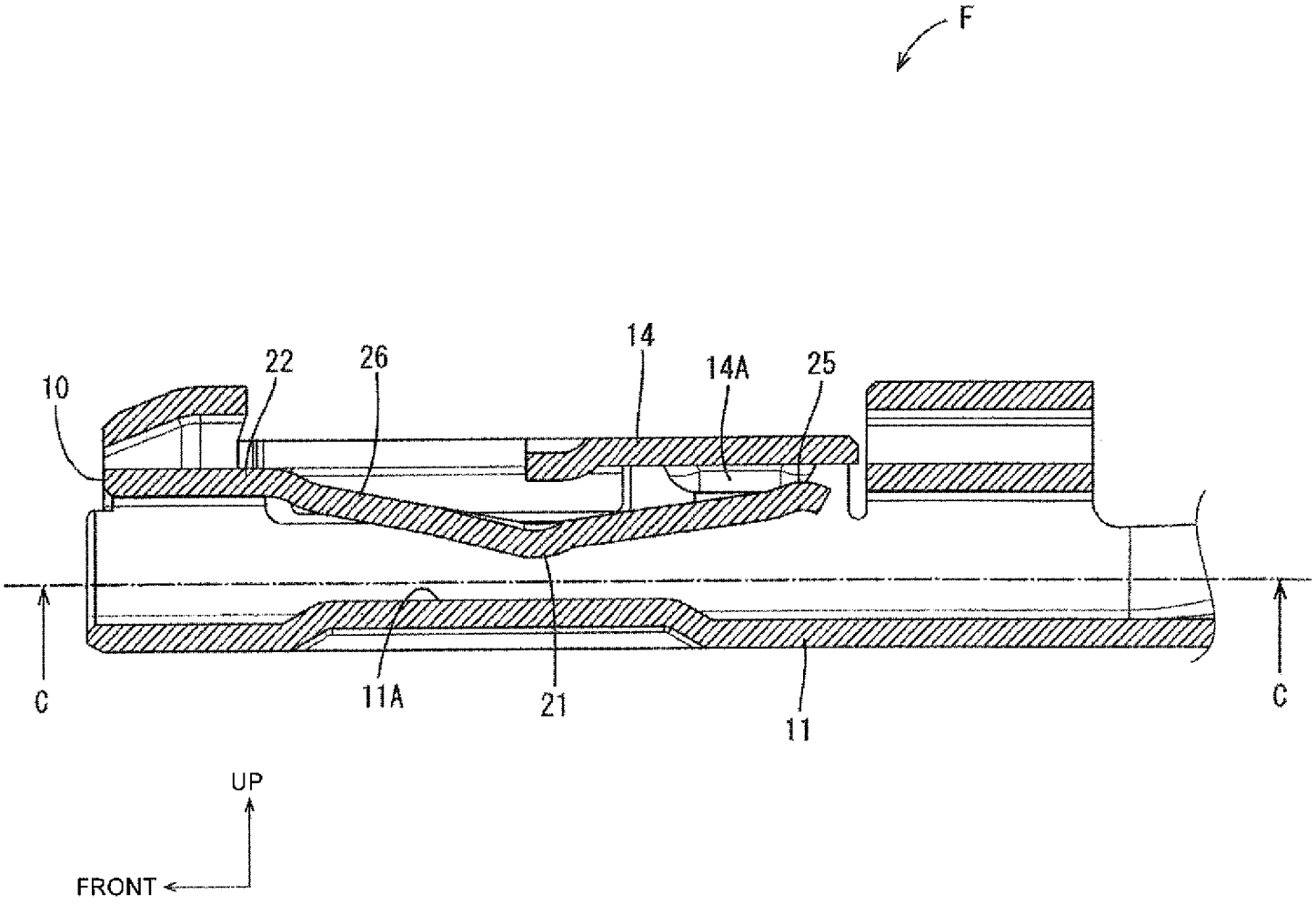
FIG. 7 is a section along B-B of FIG. 6.

The leaf spring 20 is to be connected conductively to the mating terminal M and, as shown in FIG. 7, is cantilevered rearward from a base end 22 inside the tubular body 10. An upper contact portion 21 (an example of a contact portion) projects down in a central part of the leaf spring 20 in the front-rear direction and is to be brought into contact with the mating terminal M. Note that a substantially central part of the bottom wall 11 is struck from below to form a lower contact portion 11A to project into the tubular body 10 at a position vertically facing the upper contact portion 21. The lower contact portion can be brought into contact with the mating terminal M.

Figure 8:
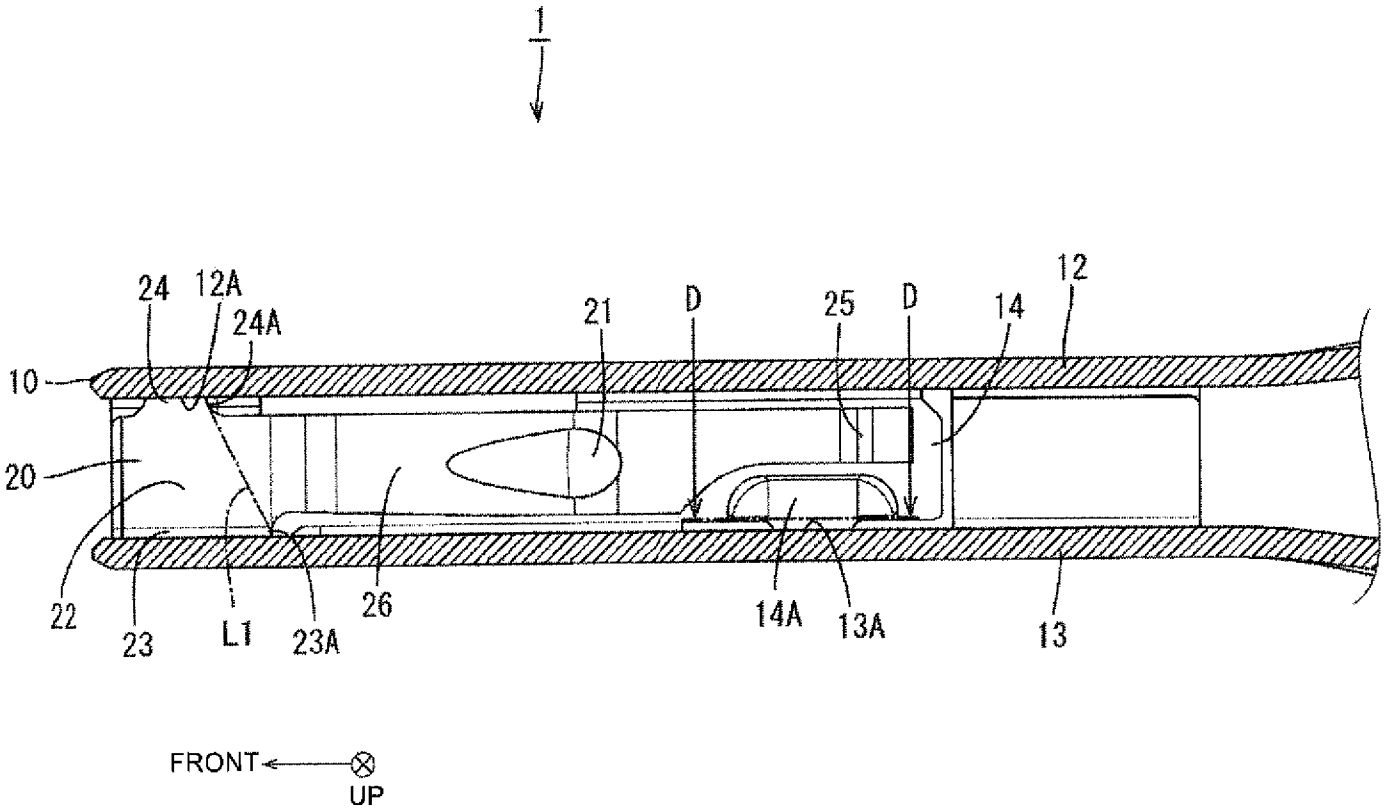
FIG. 8 is a section along C-C of FIG. 7.

The leaf spring 20 extends in the front-rear direction in the tubular body 10 and includes, as shown in FIG. 8, the base end 22 and a flexible portion 26 extending behind the base end 22. A lateral end of the base end portion 22 is coupled to the second side wall 13 at a coupling 23, and a supporting projection 24 projects on a side edge opposite to the coupling 23. A free end 25 is provided near an extending end (right end in FIG. 8) of the flexible portion 26. This free end 25 contacts the ceiling wall 14 when the mating terminal M is inserted into the tubular body 10 and the flexible portion 26 is resiliently deformed toward the ceiling wall 14. Specifically, the leaf spring 20 is supported on both ends, i.e. at two points of the base end 22 and the free end part 25.

Figure 11:
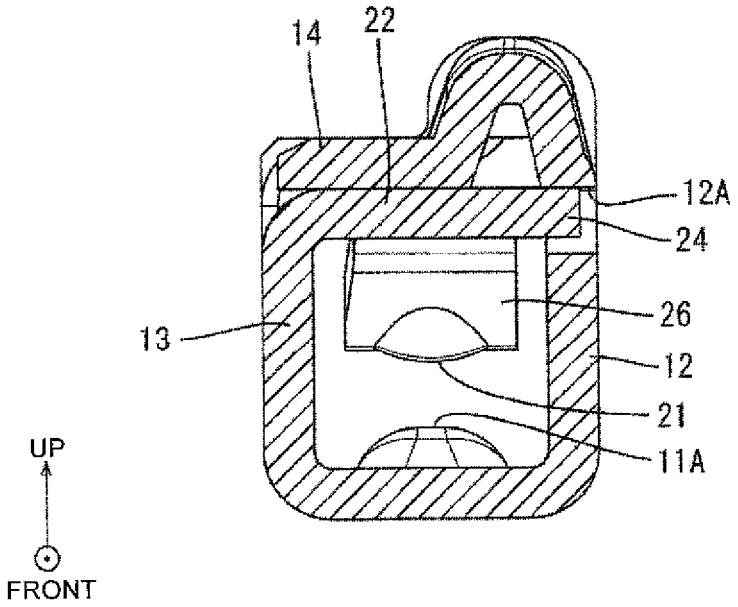
FIG. 11 is a section along E-E of FIG. 10.

A part of the leaf spring 20 in front of a boundary line L1 linearly connecting a rear end 23A of the coupling 23 and a rear end 24A of the supporting projection 24 serves as the base end 22 and a part thereof behind this line (side of the free end portion 25) serves as the flexible portion 26. As shown in FIG. 11, the base end 22 is disposed in surface contact with or at a short distance from the lower surface of the ceiling wall 14. As shown in FIGS. 7 and 8, the flexible portion 26 extends obliquely down from a position behind the boundary line L1 to the upper contact portion 21 and a part thereof behind the upper contact portion 21 is bent to extend obliquely up. In a state of FIG. 7 where the mating terminal M is not inserted in the tubular body 10, the flexible portion 26 is not in contact with the ceiling wall 14.

As shown in FIGS. 1 and 8, the coupling 23 extends laterally (down in FIG. 8) along a plate surface of the side edge of the base end part 22 on the side of the second side wall 13, is bent down at a right angle (in a direction forward of the plane of FIG. 8) and is coupled to the upper end of the second side wall 13 near a front end. In other words, the leaf spring 20 is formed integrally to the second side wall 13, and leaves only a front end part of a boundary with the second side wall 13 over a predetermined length as the coupling 23 while the boundary behind the coupling 23 is cut into a slit to form the flexible portion 26.

As shown in FIGS. 2 and 8, the supporting projection 24 extends laterally (up in FIG. 8) along a plate surface of the side edge of a front part of the base end 22 on the side of the first side wall 12. An extending end part of the supporting projection 24 is disposed in the supporting hole 12A of the first side wall 12, as shown in FIG. 11.

As shown in FIG. 8, a length in the front-rear direction of a base part of the supporting projection 24 is shorter than that of a base part of the coupling 23, and the rear end 24A of the supporting projection 24 is forward of the rear end 23A of the coupling 23 in the front-rear direction. Further, a curvature of a round surface formed from the supporting projection 24 to the flexible portion 26 is larger than that of a round surface formed from the coupling 23 to the flexible portion 26. The boundary line L1 between the base end 22 and the flexible portion 26 extends in a direction oblique to the front-rear direction, and a center of gravity of the flexible portion 26 is adjusted to a position overlapping the upper contact portion 21.

A part of the leaf spring 20 behind the upper contact portion 21 is cut on the side of the second side wall 13 to avoid the engaging projection 14A. Thus, the free end 25 is arranged near a part of the ceiling wall 14 on the side of the first side wall 12. In the state where the mating terminal M is not inserted inside the tubular body 10, the free end 25 is located lateral to the engaging projection 14A (on the side of the first side wall 12) of the ceiling wall 14 in a plan view as shown in FIG. 8, and is facing a flat surface of the ceiling wall 14 across a clearance and can contact the flat surface of the ceiling wall 14 by being resiliently deformed upwardly in a side view, as shown in FIG. 7.

In this way, with the flexible portion 26 pressed from below and the free end 25 held in contact with the ceiling wall 14, the flexible portion 26 is supported at two points of the free end 25 and the base end 22 while being kept in a stable posture.

Note that a beam 14B is formed on a part of a side edge of the ceiling 14 on the side of the second side wall 13 between the coupling 23 of the base end 22 and the engaging projection 14A. As shown in FIG. 1, the beam 14B extends laterally from the ceiling wall 14 and is bent down so that the lower end thereof faces the upper edge of the second side wall 13. In this way, the strength of the ceiling 14 constituted by one plate material against a pressing force acting in the vertical direction is enhanced.

Next, functions of the terminal F of this embodiment are described.

The female terminal F is formed from a single metal plate shaped such that the leaf spring 20, the second side wall 13, the bottom wall 11, the first side wall 12 and the ceiling 14 are connected laterally side by side in this order. The one metal plate then is subjected to stamping, press-working or the like so that this plate material is bent at respective boundaries of the leaf spring 20, the second side wall 13, the bottom wall 11, the first side wall 12 and the ceiling 14. Additionally, the supporting projection 24 of the leaf spring 20 is inserted into the supporting hole 12A of the first side wall 12, the ceiling 14 is placed above the leaf spring 20 and the engaging projection 14A is inserted into the engaging hole 13A of the second side wall 13. In this way, the female terminal F is formed in which the leaf spring 20 is accommodated integrally inside the tubular body 10 composed of the bottom wall 11, the first side wall 12, the second side wall 13 and the ceiling 14. As just described, according to this embodiment, the female terminal F can be formed from one plate material and work efficiency is good.

Figure 12:
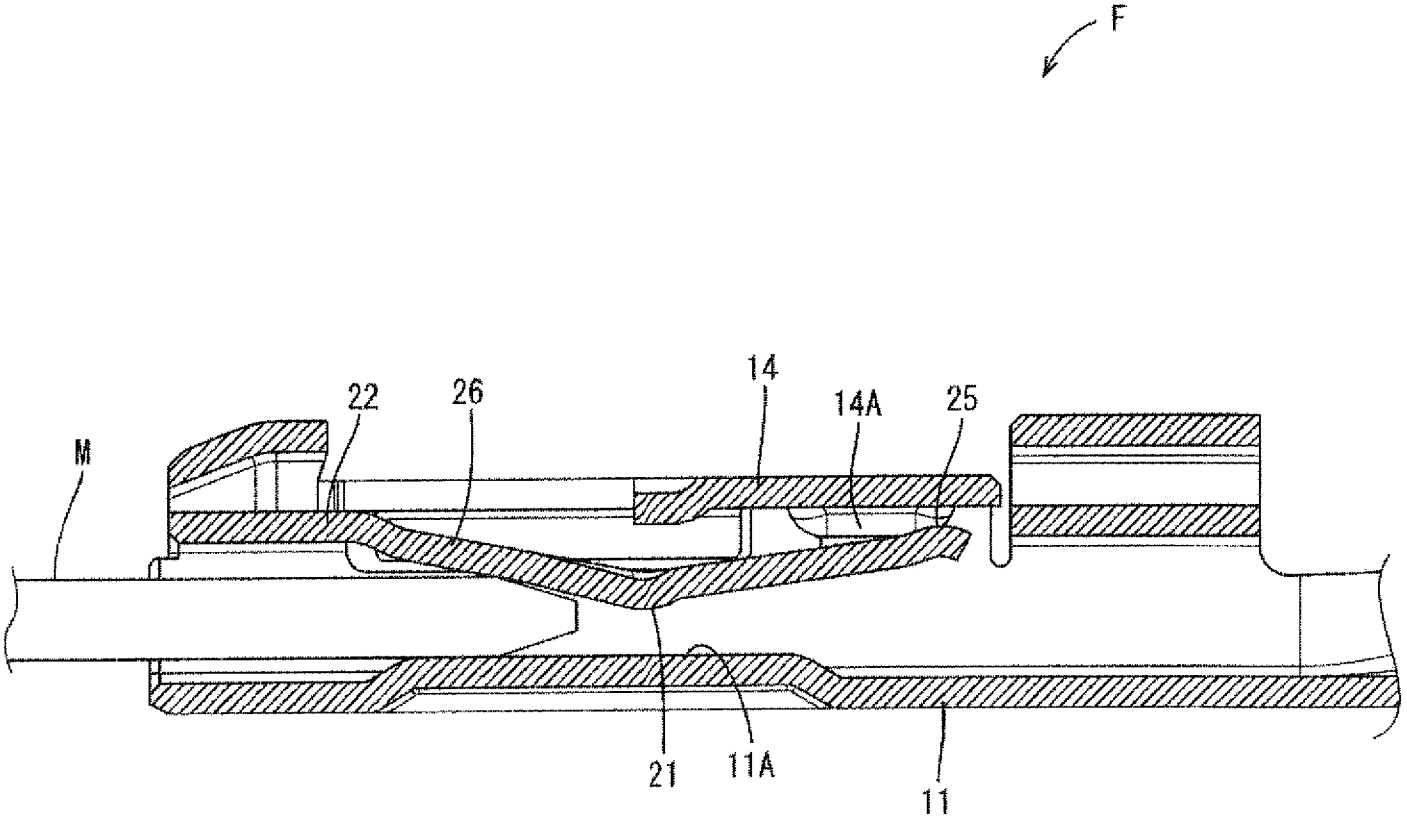
FIG. 12 is a view showing a state where a mating terminal is inserted in a tubular body
Figure 13:
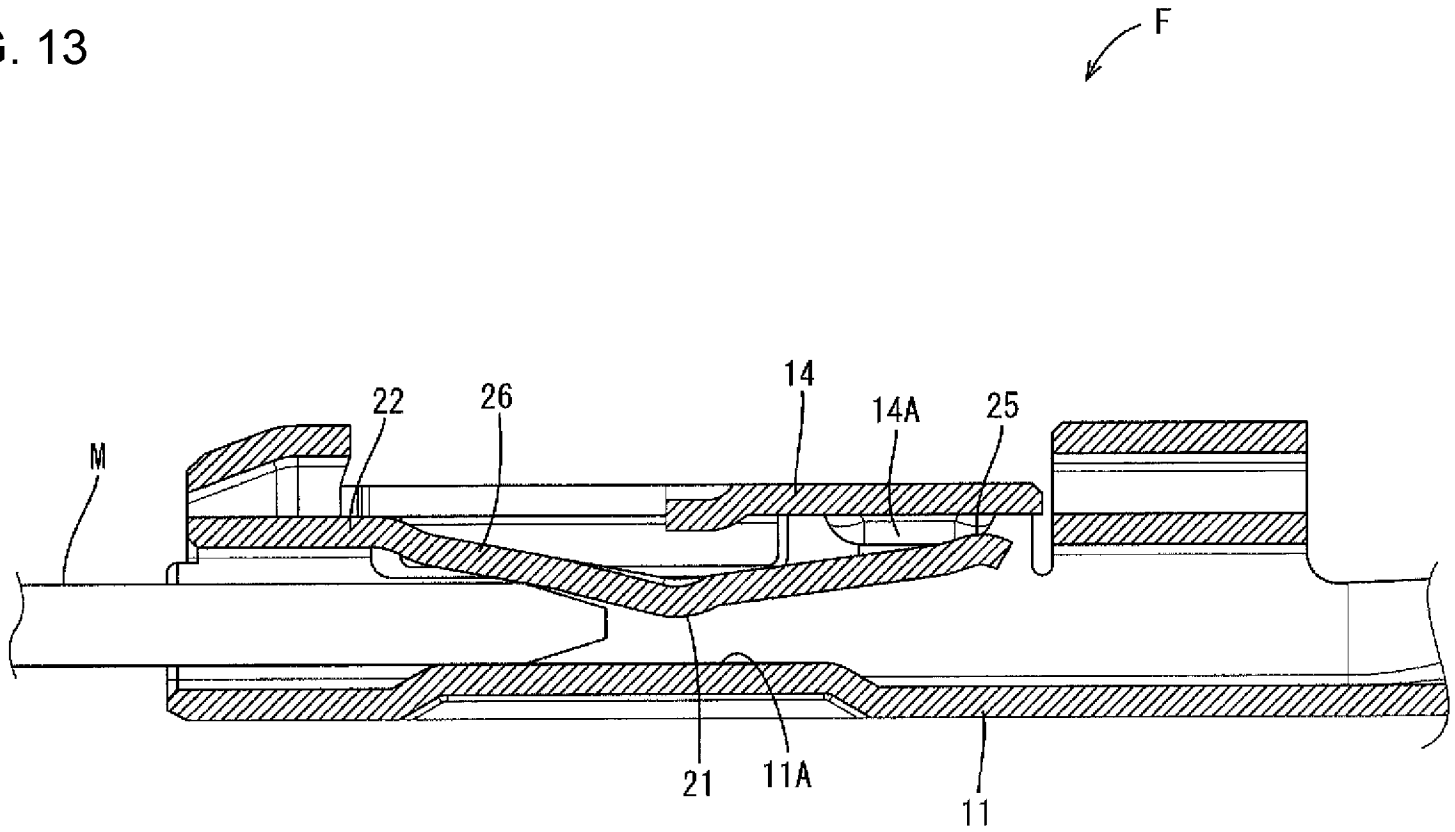
FIG. 13 is a view showing a state where the mating terminal is arranged at a connection position.

To connect this female terminal F to the mating terminal M, the mating terminal M is inserted into the tubular body 10 from the front and moves rearward while pushing up the upper contact portion 21, as shown in FIG. 12. Then, as shown in FIG. 13, the mating terminal M is sandwiched by the upper contact portion 21 and the lower contact portion 11A with the free end 25 held in contact with the ceiling wall 14 and the flexible portion 26 supported at two points of the free end 25 and the base end 22 from above in the tubular body 10, and is connected conductively to these contact portions. Note that although the free end 25 is shaped near the first side wall 12 in the lateral direction, as described above, the flexible portion 26 is in contact with the mating terminal M in a well-balanced manner (while being kept in a posture parallel to the ceiling wall 14 in a front view) without being laterally inclined since the center of gravity of the flexible portion 26 overlaps the upper contact portion 21 due to a positional relationship of the supporting projection 24 and the coupling portion 23, as described above. At this time, the ceiling wall 14 is pressed up by the free end 25, but any further upward displacement is restricted by the contact of the engaging projection 14A with the upper edge of the engaging hole 13A.

According to the above configuration, the terminal F integrally includes the tubular body 10 composed of the bottom wall 11, the first side wall 12, the second side wall 13 and the ceiling wall 14. The leaf spring 20 is cantilevered to extend in the tubular body 10. The first side wall 12 is provided with the supporting hole 12A, and the second side wall 13 is provided with the engaging hole 13A. The ceiling 14 is provided with the engaging projection 14A projecting toward the bottom wall 11 and disposed in the engaging hole 13A. The leaf spring 20 includes the base end 22, the flexible portion 26 extending rearward from the base end 22, the coupling 23 coupling the base end 22 to the second side wall 13 and the supporting projection 24 projecting from the side edge of the base end 22 opposite to the coupling 23 and disposed in the supporting hole 12A. The free end 25 of the flexible portion 26 can contact the ceiling 14 while avoiding the engaging projection 14A when the flexible portion 26 is deformed resiliently toward the ceiling wall 14.

According to this configuration, the leaf spring 20 is coupled to the second side wall 13. Thus, the terminal F can have a higher strength, for example, as compared to the case where the leaf spring 20 is formed by cutting and raising a part of the ceiling 14. Further, the base end 22 has both side edges supported by the coupling 23 and the supporting projection 24. Thus, a reduction of a contact load of the leaf spring 20 due to an opening deformation of the base end 22 or the like according to resilient deformation of the flexible portion 26 can be avoided. Furthermore, since the leaf spring 20 is supported at two points, namely the base end 22 and the free end 25 in the tubular body 10, a sufficient contact load can be ensured.

Further, the flexible portion 26 may be a part closer to the free end 25 than the straight line L1 connecting the coupling 23 and the supporting projection 24. Thus, the flexible portion 26 may be provided with the upper contact portion 21 capable of contacting the mating terminal M, and the supporting projection 24 may be provided at such a position that the center of gravity of the flexible portion 26 overlaps the contact portion 21. According to this configuration, the free end portion 25 of the leaf spring 20 is in contact with the ceiling wall 14 at the position near the first side wall 12 while avoiding the engaging projection 14A, but the center of gravity of the flexible portion 26 overlaps the contact portion 21. Thus, the leaf spring 20 can be kept in a stable posture even when contacting the mating terminal.

The invention is not limited to the above described and illustrated embodiment and can be embodied, for example, as follows.

The rear end 24A of the supporting projection 24 is forward of the rear end 23A of the coupling 23 in the front-rear direction to make the center of gravity of the flexible portion 26 overlap the upper contact portion 21 in the above embodiment. However, a positional relationship of a supporting projection and a coupling portion is not limited to this and may be set in view of other factors (plate thickness, shape of a flexible portion and the like) determining a center of gravity of the flexible portion such as a weight balance of each part.

Further, although the center of gravity of the flexible portion 26 overlaps the upper contact portion 21 in the above embodiment, a center of gravity of a flexible portion and that of an upper contact portion may not necessarily coincide if a deviation between the center of gravity of the flexible portion and the upper contact portion does not affect the connection of the upper contact portion and a mating terminal.

Although the tubular body 10 composed of the bottom wall 11, the first side wall 12, the second side wall 13 and the ceiling 14, any of which is a flat plate, and in the form of a rectangular tube as a whole is illustrated in the above embodiment, a tubular body may not have a rectangular tube shape. For example, any of a bottom wall, a first side wall, a second side wall and a ceiling may have an arc shape and these may be successively connected to form a cylindrical tubular body.

LIST OF REFERENCE SIGNS

10: tubular body
11: bottom wall
12: first side wall (first side wall)
12A: supporting hole
13: second side wall (second side wall)
13A: engaging hole
14: ceiling
14A: engaging projection
20: leaf spring
21: upper contact portion (contact portion)
22: base end
23: coupling
24: supporting projection
25: free end
26: flexible portion
F: terminal
M: mating terminal
L1: boundary line (straight line)

The invention claimed is:

1. A terminal integrally including a tubular body composed of a bottom wall, a first side wall, a second side wall and a ceiling wall and a leaf spring cantilevered and extending in the tubular body, wherein:

the first side wall is provided with a supporting hole, the second side wall is provided with an engaging hole, the ceiling wall is provided with an engaging projection projecting toward the bottom wall and disposed in the engaging hole, the leaf spring includes a base end, a flexible portion extending rearward from the base end, a coupling couples the base end to the second side wall, and a supporting projection projecting from a side edge of the base end opposite to the coupling and disposed in the supporting hole, and the free end of the flexible portion is capable of contacting the ceiling wall while avoiding the engaging projection when the flexible portion is resiliently deformed toward the ceiling wall.

2. The terminal of claim 1, wherein:

the flexible portion is a part closer to the free end than a straight line connecting the coupling and the supporting projection and is provided with a contact portion capable of contacting a mating terminal, and the supporting projection is provided at such a position that a center of gravity of the flexible portion overlaps the contact portion.

* * * * *